US010036252B2

(12) United States Patent
Ju et al.

(10) Patent No.: US 10,036,252 B2
(45) Date of Patent: Jul. 31, 2018

(54) METHOD FOR REMOVING HYDRAULIC SUPPORT FOR SOLID FILLING COAL MINING

(71) Applicant: China University of Mining and Technology, Xuzhou (CN)

(72) Inventors: Feng Ju, Xuzhou (CN); Xiexing Miao, Xuzhou (CN); Jixiong Zhang, Xuzhou (CN); Xuejie Deng, Xuzhou (CN); Xufeng Wang, Xuzhou (CN)

(73) Assignee: China University of Mining and Technology, Xuzhou (CN)

( * ) Notice: Subject to any disclaimer, the term of this patent is extended or adjusted under 35 U.S.C. 154(b) by 0 days.

(21) Appl. No.: 15/319,292

(22) PCT Filed: May 13, 2015

(86) PCT No.: PCT/CN2015/078837

§ 371 (c)(1),
(2) Date: Dec. 15, 2016

(87) PCT Pub. No.: WO2015/196872

PCT Pub. Date: Dec. 30, 2015

(65) Prior Publication Data

US 2017/0138194 A1 May 18, 2017

(30) Foreign Application Priority Data

Jun. 25, 2014 (CN) ..... 2014 1 0291182

(51) Int. Cl.
*E21D 23/04* (2006.01)
*E21D 15/60* (2006.01)
(Continued)

(52) U.S. Cl.
CPC ..... *E21D 23/0481* (2013.01); *E21D 15/60* (2013.01); *E21D 23/0004* (2013.01);
(Continued)

(58) Field of Classification Search
CPC . E21D 23/0004; E21D 23/0481; E21D 11/40; E21D 15/60; E21F 15/02; E21F 13/008; E21F 15/06; E21F 15/08
See application file for complete search history.

(56) References Cited

U.S. PATENT DOCUMENTS 3,564,857 A * 2/1971 Von Hippel ..... E21D 23/0034 248/357
3,999,804 A * 12/1976 Simpson ..... E21C 41/18 299/11
(Continued)

FOREIGN PATENT DOCUMENTS

CN 101975072 A 2/2011
CN 102086769 A 6/2011
(Continued)

OTHER PUBLICATIONS

International Search Report re PCT/CN2015/078837, dated Aug. 24, 2015, 6 pgs.

*Primary Examiner* — Carib A Oquendo
(74) *Attorney, Agent, or Firm* — Greenberg Traurig, LLP

(57) ABSTRACT

A method for removing a hydraulic support for solid filling coal mining includes digging a support removing channel (3) in a coal body (2) in front of the hydraulic support (1), and laying a support removing track (4), then removing the hydraulic support from a coal conveying gateway (11) to a track gateway (5), temporary supporting is carried out by matching a single supporting column with a n-type steel beam before each hydraulic support is removed. A supporting roof is reinforced in time by means of erecting a crib (13) and grouting after each hydraulic support is removed, three grouting pipelines (12) are laid after the supports of the whole work surface are removed, and grouting is carried out in the whole finishing cut space. The roof of the support removing space of the work surface is stable so that the
(Continued)

hydraulic supports on the work surface of solid filling coal mining are ensured to be safely and efficiently removed.

6 Claims, 2 Drawing Sheets

(51) Int. Cl.
*E21D 23/00* (2006.01)
*E21F 15/02* (2006.01)
*E21F 15/06* (2006.01)
*E21F 13/00* (2006.01)
*E21F 15/08* (2006.01)

(52) U.S. Cl.
CPC ..... *E21F 13/008* (2013.01); *E21F 15/02* (2013.01); *E21F 15/06* (2013.01); *E21F 15/08* (2013.01)

(56) References Cited

U.S. PATENT DOCUMENTS 4,309,130 A * 1/1982 Bemmerl ..... E21D 23/0409 405/291
4,480,946 A * 11/1984 Kelley ..... E21D 23/0454 299/33
4,679,856 A * 7/1987 Lubojatsky ..... E21C 41/18 299/11
5,234,256 A * 8/1993 Demircan ..... E21C 35/24 299/1.7
2007/0046094 A1* 3/2007 Gross ..... E21C 41/16 299/10
2010/0276258 A1* 11/2010 Bremhorst ..... B65G 15/26 198/812
2011/0006586 A1* 1/2011 Holme ..... E21D 23/0043 299/33
2013/0187436 A1* 7/2013 Wang ..... E21D 23/12 299/1.9
2016/0024922 A1* 1/2016 Schuster ..... E21C 27/02 299/1.6
2016/0102553 A1* 4/2016 Zhang ..... E21C 41/16 299/11
2017/0268335 A1* 9/2017 Myers ..... E21C 41/16

FOREIGN PATENT DOCUMENTS

CN 102094675 A 6/2011
CN 102312676 A 1/2012
CN 102900444 A 1/2013
CN 104131829 A 11/2014
DE 3236214 C1 9/1983

* cited by examiner

METHOD FOR REMOVING HYDRAULIC SUPPORT FOR SOLID FILLING COAL MINING

CROSS REFERENCE TO RELATED APPLICATION

The present application is a 371 U.S. National Stage of International Application No. PCT/CN2015/078837, filed May 13, 2015, which claims the benefit of the earlier filing date of Chinese Patent Application No. 201410291182.2 filed on Jun. 25, 2014, which are each incorporated herein by reference in their entirety.

FIELD OF THE DISCLOSURE

The present invention relates to a method for removing hydraulic support in mining, particularly to a method for removing hydraulic support for solid filling coal mining.

BACKGROUND OF RELATED ART

The basic principle of solid filling coal mining is to use special filling equipment, such as filling coal mining hydraulic supports and porous bottom-dump conveyors, etc., to backfill solid materials, such as gangues and coal ash, etc., into the gob, and thereby integrate comprehensive-mechanized filling technique with conventional comprehensive-mechanized coal mining technique seamlessly. To ensure enough filling space at the working face of filling coal mining, each filling coal mining hydraulic supports must have larger roof support area than ordinary chock-shield hydraulic supports. When the equipment is to be relocated at the end of the mining work at the working face of filling coal mining, filling coal mining hydraulic supports require a larger support removing channel as compared with ordinary chock-shield hydraulic supports; in addition, a wide-span finishing cut of working face where the roof is suspended will be left after the equipment is relocated. Ensuring smooth removal of filling coal mining hydraulic supports and providing temporary and reinforced support for the suspended roof at the finishing cut during the support removing process has direct influences on safe and efficient equipment relocation from the working face; in addition, after equipment relocation, providing effective and permanent support at the finishing cut is one of the key factors that have important influences on the control of overlying roof movement and surface subsidence during solid filling coal mining.

SUMMARY

Technical Problem

In view of the problems in the prior art, the object of the present invention is to provide a method for removing hydraulic supports for solid filling coal mining, which is easy to operate and low in cost, and can attain a favorable effect.

Technical Scheme

The method for removing hydraulic supports for solid filling coal mining provided in the present invention comprises the following steps:

a. excavating a support removing channel along the working face in the coal body in front of the filling coal mining hydraulic support, and supporting the exposed roof following a conventional anchor belt net and cable plus single prop approach;

b. laying support removing rails in the support removing channel, and installing a winch in the tail entry;

c. removing the coal mining machine, and the first section of scraper conveyor and the first section of filling mining conveyor in front of the first filling coal mining hydraulic support;

d. providing temporary supports within the roof control scope of the first filling coal mining hydraulic support, and then removing the first filling coal mining hydraulic support and transporting it away via the support removing rails;

e. removing the next filling coal mining hydraulic support, next section of scraper conveyor, and next section of filling mining conveyor, transporting them out, and providing temporary supports sequentially, till all of the filling coal mining hydraulic supports at the entire working face are removed;

f. providing reinforced supports for the space roof of the filling coal mining hydraulic supports, scraper conveyor and filling mining conveyor removed sequentially to form a pedestrian passageway, wherein, the array pitch L of the reinforced supports is 2.0 m;

g. clearing away other remaining devices at the working face, laying grouting pipelines in the pedestrian passageway (14), and grouting into the space; thus, the removal work of hydraulic supports for solid filling coal mining is finished.

The width of the support removing channel is 3 m~4 m.

Temporary supports are provided within the roof control scope of the first filling coal mining hydraulic support by a single prop plus π-shaped steel beam approach.

The reinforced supports are provided by erecting timber cribs, sealing the timber cribs with bonding tapes, and then grouting concrete grout into the timber cribs with a grouting machine.

The dimensions of the timber crib are 2.0 m×2.0 m.

The grouting pipelines are laid in the pedestrian passageway between two rows of timber cribs (13), and three grouting pipelines are laid from the coal conveying gateway to the tail entry.

Beneficial Effects

With the method for removing hydraulic supports for solid filling coal mining provided in the present invention, before the filling coal mining hydraulic supports are removed, a support removing channel along the working face is excavated in the coal body in front of the filling coal mining hydraulic supports, the exposed roof is supported by an anchor belt net and cable plus single prop approach, support removing rails are laid in the support removing channel, a winch is installed in the tail entry, and the equipment at the working face is transported away with the winch via the support removing rail from the coal conveying gateway to the tail entry; after the supports are removed, the stability of the suspended roof at the finishing cut is maintained by providing temporary supports by a single prop plus π-shaped steel beam approach and providing reinforced supports through erecting timber cribs and grouting concrete grout into the timber cribs; after all equipment is removed from the working face, three grouting pipelines are laid in the pedestrian passageway between two rows of timber cribs from the coal conveying gateway to the tail entry at the upper part, middle part, and lower part of the finishing cut respectively, and concrete grout is grouted into the entire space at the finishing cut through the grouting pipelines, so as to form permanent support for the overlaying strata above the finishing cut. Thus, the hydraulic supports for solid filling coal mining at the working face are removed safely and efficiently, the overlaying strata movement and surface subsidence at the finishing cut is effectively controlled. The method is easy to operate, can attain a favorable effect, and has wide practicability.

Figure 1:
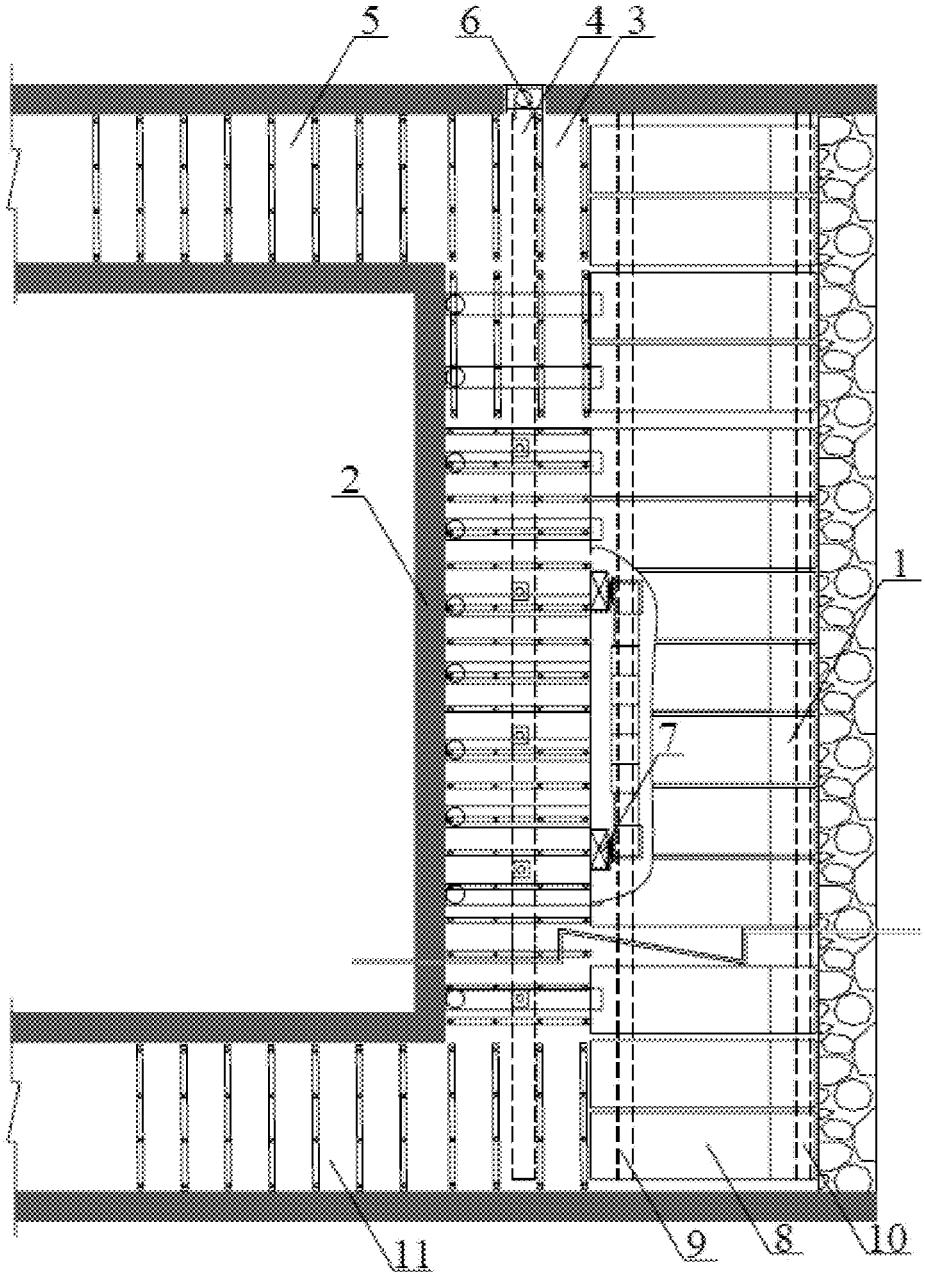
FIG. 1 is a top view of the equipment layout and roof support at the finishing cut before the filling coal mining hydraulic supports are removed in the present invention.
Figure 2:
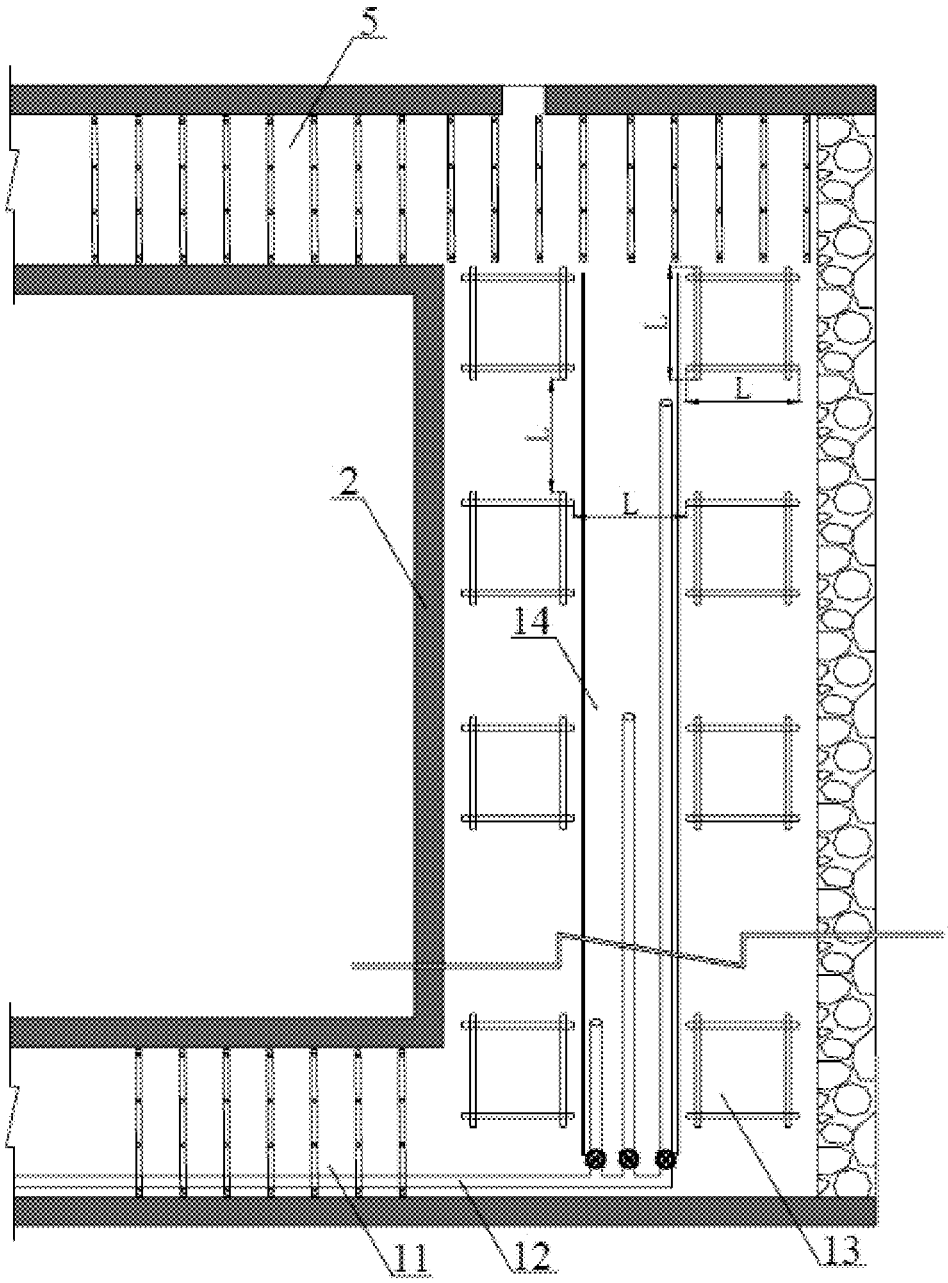
FIG. 2 is a top view of the layout of timber cribs and grouting pipelines at the finishing cut after the filling coal mining hydraulic supports are removed in the present invention.

In the figures: 1—filling coal mining hydraulic support; 2—coal body ahead; 3—support removing channel; 4—support removing rail; 5—tail entry; 6—winch; 7—coal mining machine; 8—first filling coal mining hydraulic support; 9—first section of scraper conveyor; 10—first section of filling mining conveyor; 11—coal conveying gateway; 12—grouting pipeline; 13—timber crib; 14—pedestrian passageway.

DETAILED DESCRIPTION

Hereunder the present invention will be further detailed in an embodiment, with reference to the accompanying drawings.

The method for removing hydraulic supports for solid filling coal mining provided in the present invention comprises:

a. excavating a support removing channel 3 along the working face in the coal body 2 in front of the filling coal mining hydraulic support 1, and supporting the exposed roof by a conventional anchor belt net and cable plus single prop support approach;

b. laying support removing rails 4 in the support removing channel 3, and installing a winch 6 in the tail entry 5;

c. removing the coal mining machine 7, and the first section of scraper conveyor 9 and the first section of filling mining conveyor 10 in front of the first filling coal mining hydraulic support 8;

d. providing temporary supports within the roof control scope of the first filling coal mining hydraulic support 8, and then removing the first filling coal mining hydraulic support 8 and transporting it away via the support removing rails 4 from the coal conveying gateway 11 to the tail entry 5;

e. removing the next filling coal mining hydraulic support 8, next section of scraper conveyor 9, and next section of filling mining conveyor 10, transporting them away, and providing temporary supports sequentially, till all of the filling coal mining hydraulic supports at the entire working face are removed;

f. providing reinforced supports for the space roof of the filling coal mining hydraulic supports 8, scraper conveyor 9 and filling mining conveyor 10 removed sequentially to form a pedestrian passageway 14, wherein, the array pitch L of the reinforced supports is 2.0 m;

g. clearing away other remaining devices at the working face, laying grouting pipelines 12 in the pedestrian passageway 14, and grouting into the space; thus, the removal work of hydraulic supports for solid filling coal mining is finished.

The width of the support removing channel 3 is 3 m~4 m.

Temporary supports are provided within the roof control scope of the first filling coal mining hydraulic support 8 by a single prop plus π-shaped steel beam approach.

The reinforced supports are provided by erecting timber cribs 13, sealing the timber cribs 13 with bonding tapes, and then grouting concrete grout into the timber cribs 13 with a grouting machine.

The dimensions of the timber crib 13 are 2.0 m×2.0 m.

The grouting pipelines 12 are laid in the pedestrian passageway 14 between two rows of timber cribs 13, and three grouting pipelines 12 are laid from the coal conveying gateway 11 to the tail entry 5.

Embodiment 1: Working Face III644 in Yangzhuang Coal Mine of Huaibei Mining Group as an Example The working seam at the working face III644 is coal seam 6#, the average coal thickness is 2.7 m, the average inclination is 18°, the coal seam structure is simple, and the burial depth is 360 m~515 m; the length of the working face is 340 m, the inclination width is 110 m, and fully-mechanized solid filling mining is used; The finishing cut at the working face has a rectangular cross section, with width× height=10.5 m×2.8 m, and length=110 m. The method for removing hydraulic supports for solid filling coal mining comprises the following steps:

a. excavating a support removing channel 3 having a width of 3 m along the working face III644 in the coal body 2 in front of the filling coal mining hydraulic support 1, and supporting the exposed roof by an anchor belt net and cable plus single prop approach;

b. laying support removing rails 4 in the support removing channel 3, and installing a winch 6 in the tail entry 5 of the working face III644;

c. removing the coal mining machine 7, and the first section of scraper conveyor 9 and the first section of filling mining conveyor 10 in front of the first filling coal mining hydraulic support 8;

d. providing temporary supports within the roof control scope of the first filling coal mining hydraulic support 8 by a single prop plus π-shaped steel beams approach, and then removing the first filling coal mining hydraulic support 8 and transporting it away via the support removing rails 4 from the coal conveying gateway 11 of III644 to the tail entry 5 of III644;

e. providing reinforced supports for the space roof where the first filling coal mining hydraulic support 8 is removed by erecting two rows of timber cribs 13, sealing the timber cribs 13 with bonding tapes, and then grouting concrete grout into the timber cribs 13 with a grouting machine, wherein, the dimensions of the timber crib (13) are 2.0 m×2.0 m, and the array pitch L is 2.0 m;

f. repeating step c, d and e, till all of the filling coal mining hydraulic supports at the entire working face are removed;

g. clearing away other remaining devices at the working face, laying three grouting pipelines 12 in the space of finishing cut at the working face III644 at the upper part, middle part, and lower part of the finishing cut respectively, and grouting into the finishing cut at the working face, to form permanent support for the overlying strata above the space. Thus, the hydraulic supports for solid filling coal mining at the working face are removed safely and efficiently, the overlying strata movement and surface subsidence at the finishing cut is effectively controlled.

a. excavating a support removing channel (3) along the working face in the coal body (2) in front of the filling coal mining hydraulic support (1), and supporting the exposed roof by an anchor belt net and cable plus single prop approach;

b. laying support removing rails (4) in the support removing channel (3), and installing a winch (6) in the tail entry (5);

c. removing the coal mining machine (7), and the first section of scraper conveyor (9) and the first section of filling mining conveyor (10) in front of the first filling coal mining hydraulic support (8);

d. providing temporary supports within the roof control scope of the first filling coal mining hydraulic support (8), and then removing the first filling coal mining hydraulic support (8) and transporting it away via the support removing rails (4) from the coal conveying gateway (11) to the tail entry (5);

e. providing reinforced supports for the space roof where the first filling coal mining hydraulic support (8) is removed;

f. repeating step c, d and e, till all of the filling coal mining hydraulic supports at the entire working face are removed;

g. clearing away other remaining devices at the working face, laying grouting pipelines (12) in the at the working face space, and grouting into the finishing cut space at the working face; thus, the removal work of hydraulic supports for solid filling coal mining is finished.

The width of the support removing channel (3) is 3 m~4 m; temporary supports are provided within the roof control scope of the first filling coal mining hydraulic support (8) by a single prop plus π-shaped steel beam approach; reinforced supports are provided for the space roof where the first filling coal mining hydraulic support (8) is removed by erecting timber cribs (13), sealing the timber cribs (13) with bonding tapes, and then grouting concrete grout into the timber cribs (13) with a grouting machine, wherein, the dimensions of the timber crib (13) are 2.0 m×2.0 m, and the array pitch L is 2.0 m; grouting pipelines (12) are laid in the finishing cut space at the working face in the pedestrian passageway (14) between two rows of timber cribs, and three grouting pipelines (12) are laid from the coal conveying gateway (11) to the tail entry (5) at the upper part, middle part, and lower part of the finishing cut at the working face respectively.

We claim:

1. A method for removing a plurality of filling coal mining hydraulic supports for solid filling coal mining, comprising the following steps:

a. excavating a support removing channel along a working face in a coal body in front of a first filling coal mining hydraulic support, and supporting an exposed roof by a conventional anchor belt net and a cable plus single prop approach;

b. laying support removing rails in the support removing channel, and installing a winch in a tail entry of the removing channel;

c. removing a coal mining machine, and a first section of a scraper conveyor and a first section of a filling mining conveyor in front of the first filling coal mining hydraulic support;

d. providing temporary supports within a roof control scope of the first filling coal mining hydraulic support, and then removing the first filling coal mining hydraulic support and transporting the removed first filling coal mining hydraulic support along the support removing channel via the support removing rails;

e. repeating steps (a) through (d) until all of the plurality of filling coal mining hydraulic supports along the entire working face in the coal body are removed;

f. providing a plurality of reinforced supports for supporting the exposed roof to form a pedestrian passageway, wherein, the distance between the reinforced supports is 2.0 m; and g. clearing the working face, laying grouting pipelines in the pedestrian passageway, and grouting into the grouting pipelines.

2. The method for removing a plurality of filling coal mining hydraulic supports according to claim 1, wherein a width of the support removing channel is between 3 m and 4 m.

3. The method for removing a plurality of filling coal mining hydraulic supports according to claim 1, wherein the temporary supports are pi-shaped (π-shaped) steel beams.

4. The method for removing a plurality of filling coal mining hydraulic supports according to claim 1, wherein the plurality of reinforced supports are provided by erecting timber cribs, sealing the timber cribs with a bonding tape, and grouting concrete grout into the timber cribs with a grouting machine.

5. The method for removing a plurality of filling coal mining hydraulic supports according to claim 4, wherein the dimensions of the timber cribs are 2.0 m×2.0 m.

6. The method for removing a plurality of filling coal mining hydraulic supports according to claim 1, wherein the grouting pipelines are laid in the pedestrian passageway between two rows of the timber cribs, and three grouting pipelines are laid from a coal conveying gateway to the tail entry.

* * * * *